United States Patent [19]

Cook et al.

[11] Patent Number: 4,472,906

[45] Date of Patent: Sep. 25, 1984

[54] MANUALLY ACTIVATED TOY VEHICLE LAUNCHER

[75] Inventors: Stuart A. Cook, New Richmond; Barry Fichter, Cincinnati, both of Ohio

[73] Assignee: CPG Products Corp., Minneapolis, Minn.

[21] Appl. No.: 500,674

[22] Filed: Jun. 3, 1983

[51] Int. Cl.[3] ..... A63H 33/00

[52] U.S. Cl. ..... 446/429; 124/79; 273/86 D

[58] Field of Search ..... 46/1 K, 202, 206, 201; 273/86 D, 129 T, 79; 124/21, 26, 79, 1

[56] References Cited

U.S. PATENT DOCUMENTS

| | | | |
|---|---|---|---|
| 2,607,163 | 8/1952 | Lohr | 46/206 |
| 2,803,922 | 8/1957 | Holt | 46/202 |
| 3,693,282 | 9/1972 | Adicks et al. | 46/202 X |
| 3,777,391 | 12/1973 | Barcus et al. | 46/1 K |
| 3,877,169 | 4/1975 | Munday et al. | 46/206 X |
| 4,087,935 | 5/1978 | Edmisson et al. | 46/206 X |
| 4,108,437 | 8/1978 | DeAnda et al. | 46/1 K X |

*Primary Examiner*—F. Barry Shay

*Attorney, Agent, or Firm*—Gene O. Enockson; L. MeRoy Lillehaugen

[57] ABSTRACT

The toy vehicle launcher includes lower and upper casing units, the upper unit being slidable in a rectilinear direction relative to the lower unit. Rubber feet on the lower unit frictionally engage the playing surface onto which the toy vehicle is launched. The vehicle is acted upon by a ram having a gear rack in mesh with a relatively large circular gear. Two relatively small circular gears are in mesh with a gear rack on the lower casing unit. All three gears are mounted for rotation in unison on a shaft journaled in bearing plates integral with the upper unit. Manual actuation of the upper casing unit in one axial direction relative to the lower casing unit causes the ram to push the toy vehicle, thereby launching the vehicle.

17 Claims, 10 Drawing Figures

MANUALLY ACTIVATED TOY VEHICLE LAUNCHER

BACKGROUND OF THE INVENTION

1. Field of the Invention

This invention relates generally to amusement devices, and pertains more particularly to a manually actuated toy vehicle launcher.

2. Description of the Prior Art

A number of toy launchers are disclosed in the patent literature. Elastic bands and springs have been employed. Air propulsion has been utilized. Also, a relatively large number of vehicle launchers have been contrived in which the manual force is applied directly to the vehicle in order to effect movement of the vehicle from a stationary position.

Perhaps the closest patent, although still quite dissimilar, is U.S. Pat. No. 4,087,935, granted to Edmisson et al on May 9, 1978, for "TOY VEHICLE WITH HOUSING." This patent discloses a toy vehicle in which the manual force is indirectly applied in that an inertia motor mounted on the vehicle is set spinning by depressing a plunger. More specifically, the plunger actuates a gear train and belt to cause spinning of the inertia motor. When its inertia motor reaches a sufficiently high spinning rate, the toy vehicle leaves the housing in which the plunger, gears and belt are located, then rolling across a flat surface. A spring causes the plunger to return to its original or raised position so that it can be again actuated to literally rewind the inertia motor when the toy vehicle is replaced within the housing.

SUMMARY OF THE INVENTION

An important object of our invention is to provide a toy launcher that appreciably multiplies the applied motion, so that a toy vehicle or other item is launched at a speed several times that of the child's hand, thereby enabling younger children to launch the vehicle at more exciting speeds.

Another object of our invention is to provide a launcher that will require a certain amount of dexterity and skill in launching the vehicle. In this way, the child can make successive launches, keeping track of the distance the toy vehicle travels after each launch. There is an additional appeal in that the launcher lends itself readily to being used in competition with similar launchers, thereby enabling races to be conducted.

Even though our launcher finds especial utility in a competitive environment, as mentioned above, it can be used noncompetitively as well. Stated somewhat differently, an aim of the invention is to provide a launcher that will prove of interest to virtually all ages in that it can be easily manipulated by small children, the child deriving appreciable enjoyment by merely watching the toy vehicle emerge from the launcher at whatever speed is realized.

Another object is to provide a toy launcher that will be inexpensive to manufacture, thereby encouraging its widespread purchase and use.

Yet another object is to provide a safer launcher, in that this invention does not depend on stored energy, that can accidently by released, to launch the vehicle.

Another object of the invention is to provide a launcher that will be rugged and not apt to be broken during its normal use and handling.

Still further, an object is to provide a launcher that is compact, requiring but little space when stored.

Although it is preferable to use a toy vehicle dimensioned in accordance with the size of the launcher, an object of the invention is to permit smaller vehicles to be substituted when the intended toy vehicle is lost or misplaced.

Briefly, our invention envisages a launcher comprised of two casing components or units which are slidably mated together so that the top unit can be moved axially along the lower unit. Rubber feet are provided on the underside of the lower unit so that it resists movement along the playing surface. A ram is constrained for reciprocable movement within the launcher. A motion multiplying mechanism is employed so that when the upper casing unit is moved forwardly, then the ram is actuated at a faster speed than the upper casing unit is moved. It is the accelerated action that causes the ram to engage the rear end of the toy vehicle, the toy vehicle thus being thrust from the launcher at a rapid velocity and with considerable momentum.

The motion multiplying means that transmits motion from the upper casing unit to the ram includes a gear train comprised of a gear rack attached to the ram and a pair of laterally spaced gear racks on the lower casing unit. A shaft has its ends rotatably journaled in the sides of the upper unit, the shaft having a relatively large diameter circular gear engaged with the rack on the ram and a pair of smaller gears flanking the larger gear, the two smaller gears being engaged with the two laterally spaced racks.

In this way, when a toy vehicle is placed within the launcher, the manual movement of the upper casing unit relative to the lower casing unit causes the motion transmitting means to actuate the ram at a faster rate than the upper casing unit is moved, the rapid movement of the ram propelling the toy vehicle at a fast speed from the launcher onto the playing surface upon which the lower casing unit has been placed.

BRIEF DESCRIPTION OF THE DRAWINGS

FIG. 3 is a front elevational view taken from the left in FIGS. 1 and 2;

DESCRIPTION OF THE PREFERRED EMBODIMENT

Figure 1:
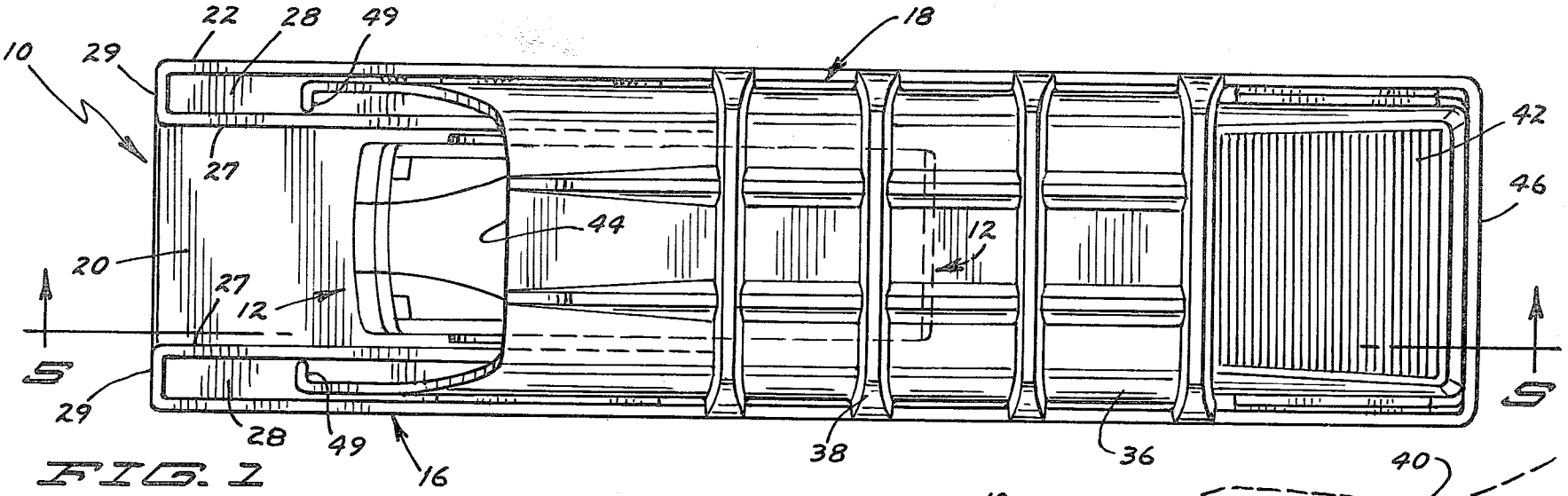
FIG. 1 is a top plan view of a launcher exemplifying our invention, the upper casing unit being retracted or pulled to the right relative to the lower casing unit preparatory to launching a vehicle contained within the launcher.

Referring now in detail to the drawings, the launcher illustrating our invention has been indicated generally by the reference numeral 10. The launcher 10 is intended to launch or eject a toy vehicle 12 onto a playing surface 14.

Describing the launcher 10, it is to be observed that it includes a lower casing component or unit denoted generally by the reference numeral 16 and an upper casing component or unit denoted generally by the reference numeral 18, both being molded from a suitable material, such as ABS plastic. As the description progresses, it will become clear that the upper unit 18 is constrained for rectilinear movement relative to the lower casing unit 16.

Figure 7:
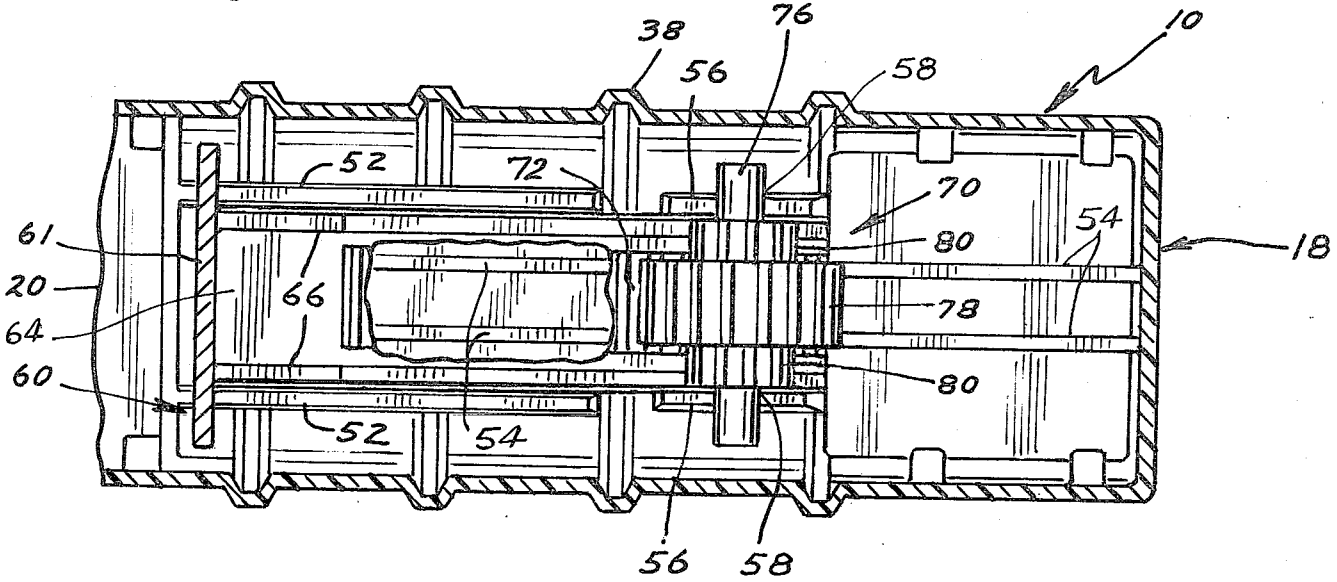
FIG. 7 is a fragmentary sectional view taken in the direction of line 7—7 of FIG. 6 for the purpose of showing the ram that effects the launching action, together with the motion transmitting means.

Describing the lower casing unit 16 in greater detail, it will be observed that it includes a floor or bottom wall 20, the toy vehicle 12 being placed on the forward or left portion thereof prior to effecting a launching. Side walls 22 extend upwardly from the floor or bottom wall 20. As best understood from FIG. 10, the side walls 22 are formed with forwardly and rearwardly located, inwardly extending hooks or shoulders 24 having upwardly and outwardly sloping cam surfaces 25, thereby providing an inwardly facing vertical channel 26 at each side of the casing 16, the bottom of each vertical channel 26 constituting a portion of the underlying floor 20. Inset from the side walls 22 are upstanding guide ribs 27, the guide ribs 27 being laterally spaced so as to guide the upper casing 18, in the laterally spaced grooves or tracks 28, formed between the side walls 22 and ribs 27 during launching. The inwardly facing sides of the ribs 27, of course, guide the vehicle 12 as it is pushed along the floor in a manner yet to be described. The ribs labeled **27*a* are intermediate or longitudinal continuations of the ribs 27, spanning only a portion of the length of the casing unit 16, as will be seen from FIGS. 5 and 7, and which are more elevated than the ribs 27, as can be seen from comparing FIG. 9 with FIG. 10**. The function of the ribs is better left for later reference.

While the forward ends of the grooves 28 are closed by reason of end walls or stops 29 extending between the side walls 22 and ribs 27, it can be discerned from FIGS. 1 and 3 that the front end of the launcher 10 is open, as measured laterally between the ribs 27, the open end being designated by the reference numeral 30. The rear or opposite end of the launcher 10, however, is closed, there being an upstanding rear wall 32 and an upstanding obstruction wall or stop 34, the stops 29 and 34 limiting the foward movement of the upper casing unit 18 relative to the lower casing unit 16, as will soon be made clear.

Figure 2:
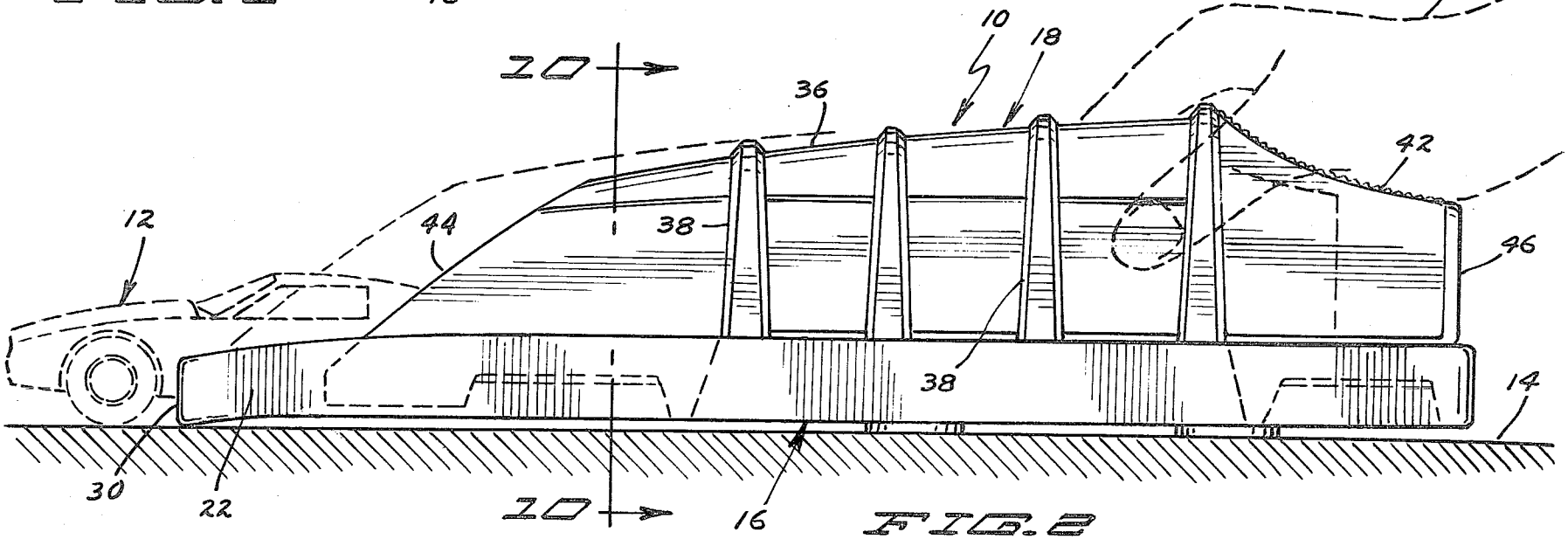
FIG. 2 is a side elevational view corresponding to FIG. 1, a person's hand having been depicted in phantom outline at the right and the toy vehicle in phantom outline at the left as it leaves the launcher.
Figure 4:
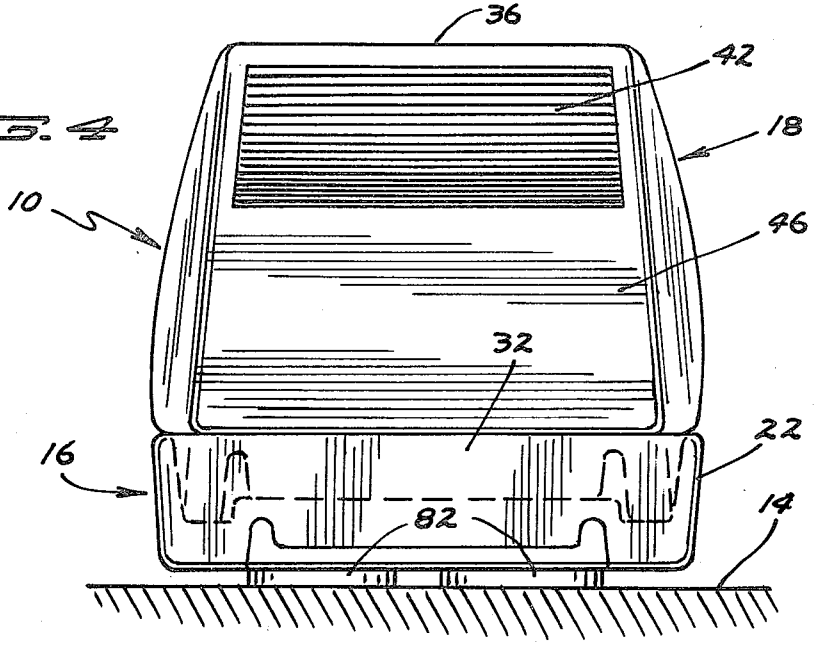
FIG. 4 is a rear elevational view taken from the right in FIGS. 1 and 2.

Describing the upper casing unit 18 in greater detail, it will be perceived that it has a top wall 36 having a number of reinforcing transverse ribs 38 that also facilitate the grasping of the upper unit 18 by a person's hand 40, such as that indicated in phantom outline in FIG. 2. At the rear of the top wall 36 is a sloping knurled panel 42. The forward end of the upper casing unit 18 is open as indicated by the reference numeral 44. However, the rear end is closed, there being a wall 46 extending downwardly from the knurled panel 42.

Downwardly extending side walls 48, which are provided with inturned ears 49 at the left, are formed with hook or shoulders 50 that slidably underlie the previously mentioned hook or shoulders 24 on the side walls 22 of the lower casing unit 16. The hooks or shoulders 50 have upwardly and outwardly sloping cam surfaces 51. The side walls 48 are sufficiently resilient so that the cam surfaces 25, 51 enable the two casing units 16, 18 to be snapped together. In this way, the lower marginal portions, that is, the portions beneath the hooks 50, of the side walls 48 slide or ride in the channels 26 formed in the side walls 22. Stated somewhat differently, the upper casing unit 18, when assembled with the lower casing unit 16, is constrained for rectilinear movement relative to the lower casing unit 16 by means of the interengaging hooks 24, 50. The movement of the upper casing unit 18 to the right of its retracted position is limited by the rear wall 46 of the upper casing unit 18 striking the rear wall 32 of the lower casing unit 16. The movement of the upper casing unit 18 to the left of its advanced position is limited by the rear wall 46 striking the obstruction wall or stop 34. The forward ends of the side walls 48 of the casing unit 18, which are formed with the inturned ears 49, are intended to simultaneously strike the stops 29 when the rear wall 46 strikes the stop 34.

Figure 10:
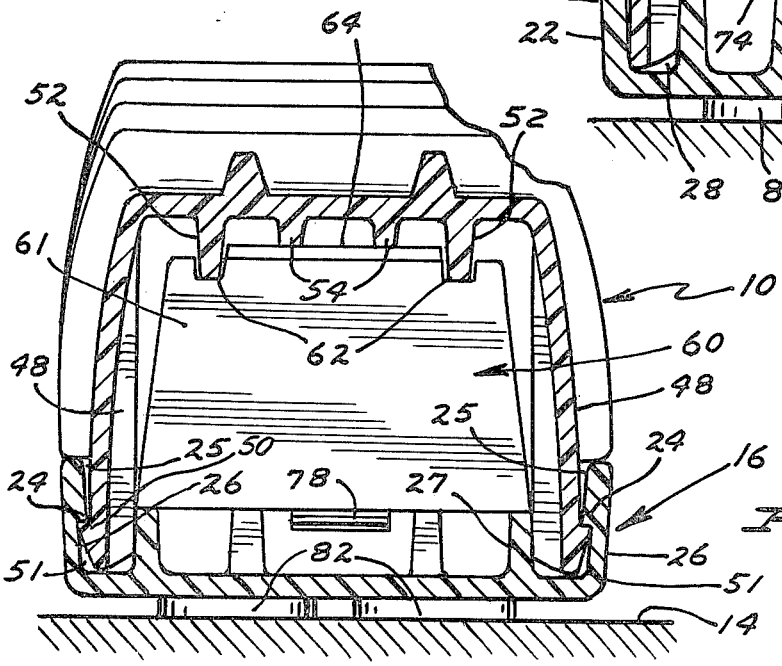
FIG. 10 is a sectional view taken in the direction of line 10—10 of FIG. 2, the view showing the manner in which the lower and upper casing units are slidably mated so that the upper unit can be manually advanced relative to the lower unit in effecting a launch.

Continuing with a description of the upper casing unit 18, it will be noted, especially from FIG. 10, there is a pair of downwardly depending outer guide ribs 52 and a pair of downwardly depending inner guide ribs 54. The function or purpose of the ribs 52, 54 is better reserved for discussion hereinafter. At this time, though, it will be well to point out that there are two laterally spaced bearing plates 56 depending downwardly from the top wall 36, each formed with a notch 58 at its lower edge. Here again, the function of the bearing plates 56 and the notches 58 will be made clear hereinafter.

Playing an important role in the practicing of our invention is a ram, also of plastic, indicated generally by the reference numeral 60. The ram 60 includes a vertical thrust panel 61 formed with laterally spaced upper notches 62 and a horizontal flat strip or shank 64 extending rearwardly or to the right from the thrust panel 61. Strengthening or reinforcing the thrust panel 61 with respect to the shank 64 are gussets 66.

Also playing an important part in accomplishing the aims of our invention is a motion transmitting mechanism that has been generally assigned the reference numeral 70. It can be explained at this stage that the motion transmitting mechanism 70 functions as a motion multiplying means. The motion transmitting mechanism 70 comprises a gear rack 72 fixedly disposed on the underside of the shank 64. Also included in the mechanism 70 is a pair of laterally spaced gear racks 74, these racks 74 being affixed to the floor or bottom wall 20 of the lower casing unit 16. Still further, the mechanism 70 includes a shaft or axle 76 that is journaled in the previously mentioned notches 58 formed in the lower edges of the bearing plates 56. The shaft 76 has thereon a relatively large circular gear 78 and two flanking smaller circular gears 80.

Figure 9:
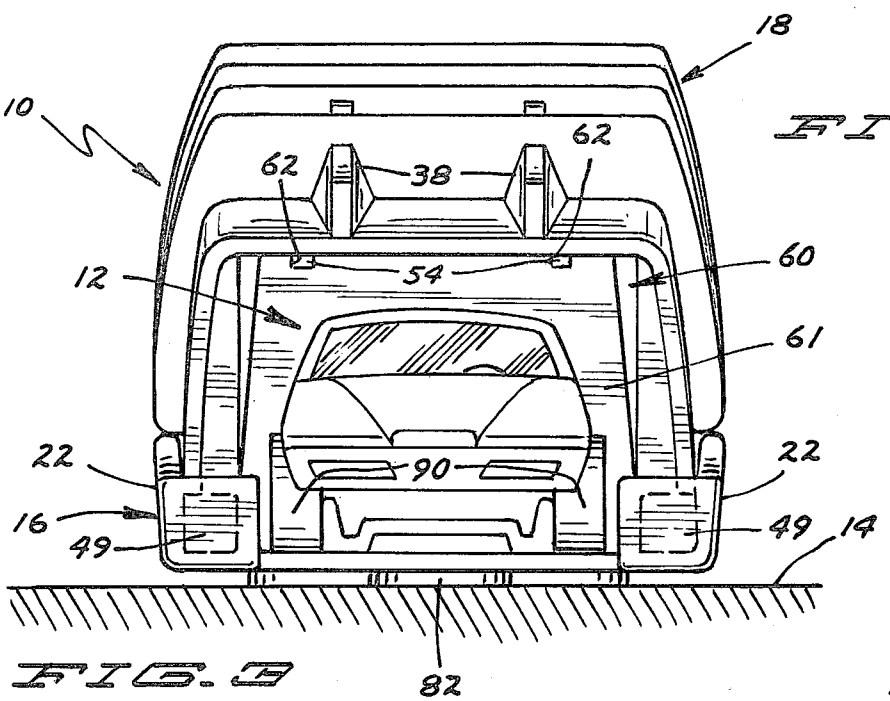
FIG. 9 is a view of the motion transmitting means, the view being taken in the direction of line 9—9 of FIG. 5.

It will be well at this time to explain that the outside diameter of the larger or bull gear 78 is twice that of the smaller gears or pinions 80. More specifically, the outer diameter of the larger gear 78 is 1.0 inch, whereas the outside diameter of the smaller gears 80 is 0.5 inch. Still further, the larger gear 78 is formed with eighteen teeth, whereas the smaller gears 80 are formed with eight teeth. By reason of the difference in diameters and the difference in the number of gear teeth, it should be recognized that a motion multiplying action is derived from the fact that the smaller gears 80 are in mesh with the gear racks 74, whereas the larger gear 78 is in mesh with the gear rack 72. It can also be appreciated, particularly from FIG. 9, that the gear racks 74 are laterally spaced so as to accommodate therebetween the periphery of the larger gear 78. FIG. 9 also shows, as do FIGS. 5 and 6, the engagement of the larger gear 78 with the gear rack 72 and the engagement of the gears 80 with the gear racks 74.

Inasmuch as it is planned that the lower casing unit 16 remain immobile relative to the playing surface 14, attention is directed at this time to three elastomeric or rubber feet 82 that bear against the playing surface 14, there being a similar number of holes 84 formed in the floor or bottom wall 20 of the lower casing unit 16. By using three rubber feet 82, it will be appreciated that all three feet 82 will rest on the surface 14 and frictionally resist movement without any wobbling that could occur if the feet 82 were not all in a single plane (such as where four or more feet are employed).

The toy vehicle 12 has been only generally mentioned. While the construction thereof is not critical to a practicing of the invention, nonetheless it will be pointed out that the vehicle 12 includes a body 86 having a rear bumper 88. It is desirable that the wheels of the vehicle, which have been labeled 90, have a lateral spacing such that the outer faces thereof can glide against the upstanding ribs 27. It will be recognized that the toy vehicle 12 should be guided in a straight path when launched; having the spacing of the wheels 90 commensurate with the spacing of the ribs 27 assures that the vehicle 12 will traverse a straight line path during the launching operation. A slight depression or shallow trough 92 extends transversely between the ribs 27; the rear wheels 90 of the vehicle 12 rest in this depression 92, thereby keeping the vehicle 12 in place until a launch is inaugurated (see FIGS. 5 and 6). The child may substitute a toy car having a lesser width if he/she chooses to do so, but with a somewhat poorer guiding action where a lesser width toy is employed. Even other objects, such as marbles, may be used.

Figure 5:
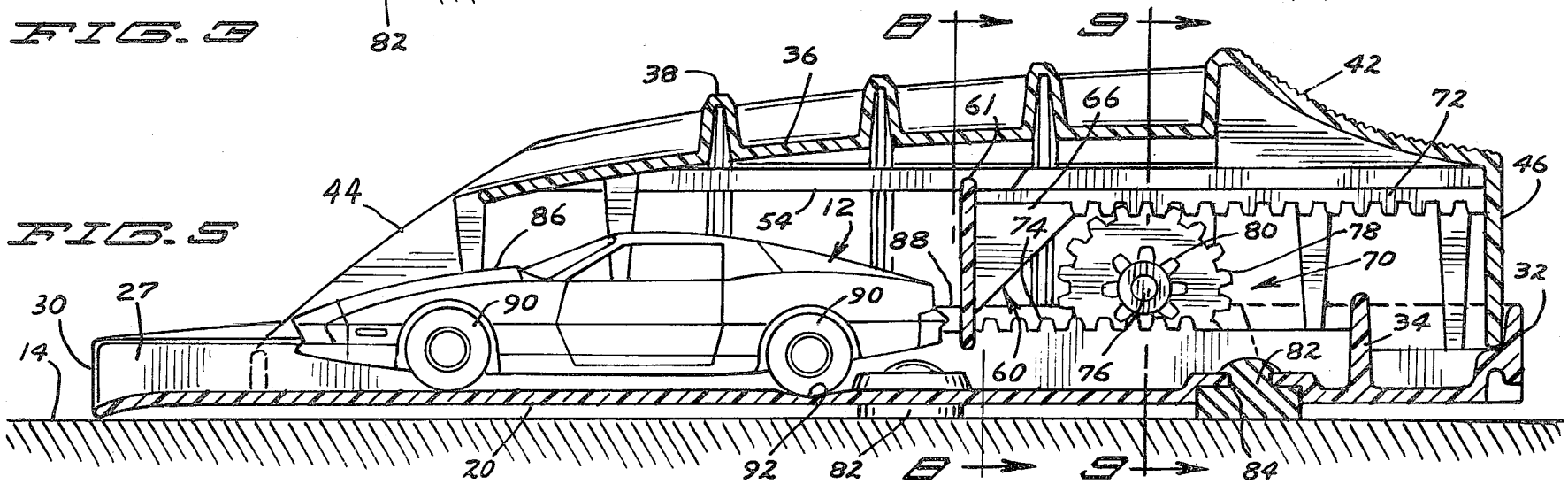
FIG. 5 is a sectional view taken in the direction of line 5—5 of FIG. 1, the view illustrating the toy vehicle before launching.
Figure 6:
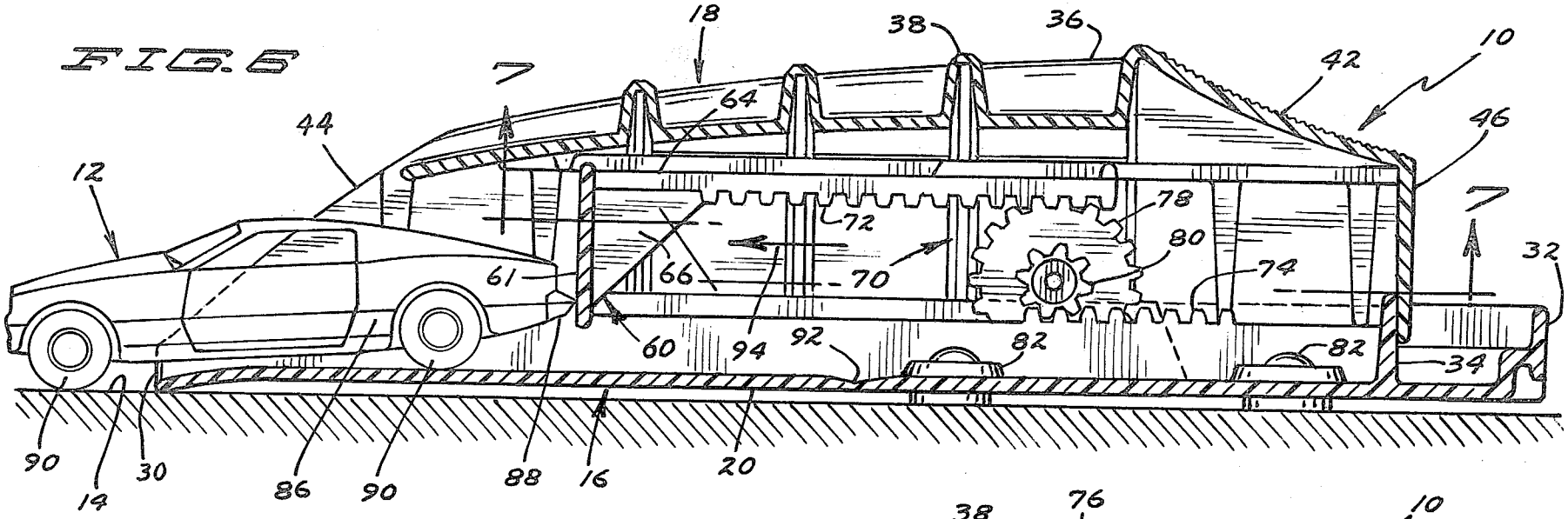
FIG. 6 is a sectional view corresponding generally to FIG. 5 but with the vehicle being launched, the vehicle being in the same position as shown in phantom outline in FIG. 2.

Having presented the foregoing description, the manner in which our launcher 10 is operated should be readily understandable. Nonetheless, it can be briefly explained that when the lower casing unit 16 is placed on the playing surface 14, it remains stationary by reason of the elastomeric feet 82 when the upper casing unit 18 is manually moved in the direction of the arrow 94 of FIG. 6. The initial or retracted position of the upper casing unit 18 is illustrated in FIG. 5. It is when the upper casing unit 18 is advanced relative to the lower casing unit 16 that the ram 60 is moved in a direction to engage the rear bumper 88 of the vehicle 12. This manual movement is readily accomplished by simply grasping the rear portion of the upper casing unit 18 by one's hand, the hand 40 having been superimposed in phantom outline in FIG. 2. It is preferable that the hand 40 grasp the rear portion of the upper casing unit 18 so as to exert a downward pressure in the region where the several rubber feet 82 are located. This assures that the lower casing unit 16 will remain relatively fixed on the playing surface 14.

As the person's hand 40 advances the upper casing unit 18 in the direction of the arrow 94, it should be recognized that the shaft or axle 76 is moved in unison therewith inasmuch as the earlier-mentioned bearing plates 56 are integral with the casing unit 18, the notches 58 literally dragging the shaft 76 along with the upper casing unit 18, the ends of the shaft 76 rolling on the upper edges of ribs 27*a*, as can be understood from FIG. 9. The ribs 27*a*, which span only a portion of the length of the lower casing unit, need only be coextensive in length with the length of the gear racks 74 in that the ribs 27*a* serve as rails underlying the shaft 76, thereby maintaining the shaft 76 in the notches 58.

Figure 8:
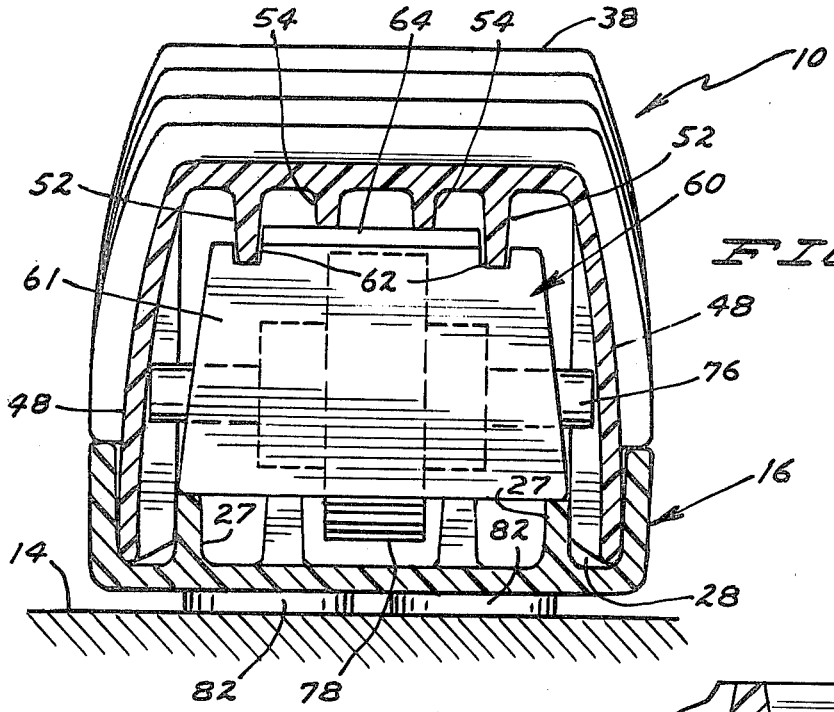
FIG. 8 is a vertical sectional view taken in the direction of line 8—8 of FIG. 5 for the purpose of showing the ram and the manner in which it is constrained for reciprocable movement within the relatively movable casing units.
Figure 9:
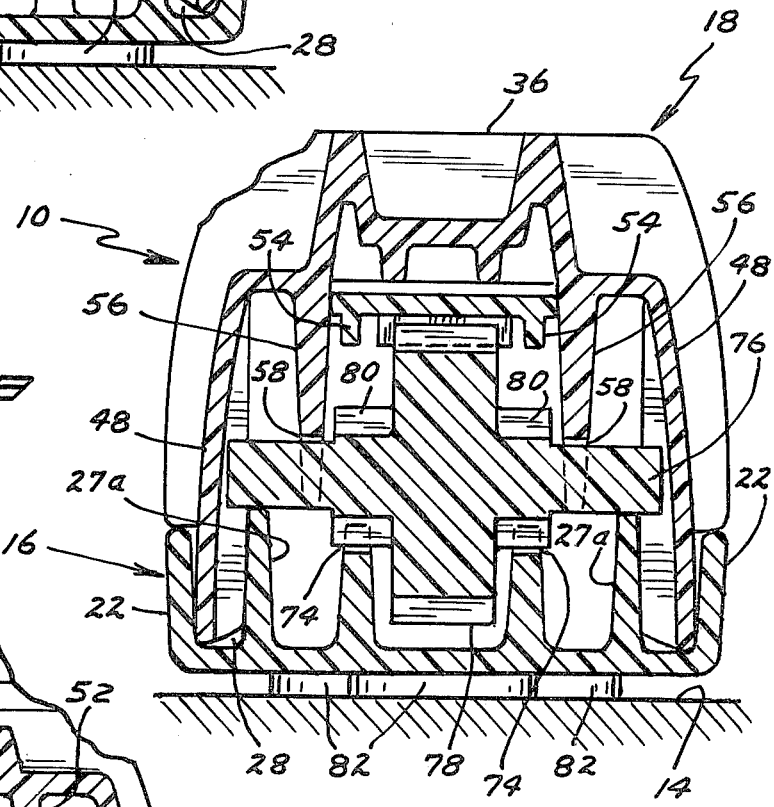

The manual actuation of the upper casing unit 18 in the direction of the arrow 94 thus causes the two smaller gears 80, which are in engagement with the two laterally spaced gear racks 74, to move therealong. The rotation of the two smaller gears 80, inasmuch as they are fixedly carried on the shaft 76, cause the larger gear 78 to rotate in unison therewith. Since the larger gear 78 is in mesh with the gear rack 72, it follows that the mechanism, which has been denoted generally by the reference numeral 70, effects a more rapid movement of the ram 60, causing its thrust panel 61 to push against the rear bumper 88 of the vehicle 12 with the consequence that the vehicle 12 is rapidly accelerated and ejected from the launcher 10. As a result of the gear 78 having eighteen teeth and the gears 80 having eight teeth, the ram 60 moves 3.25 times faster than the upper casing 18. From FIGS. 8 and 10 it will be discerned that the thrust panel 61, owing to the notches 62 therein, is guided by the downwardly depending ribs 54, the lower edge of the thrust panel 61 riding along the ribs 54, as also understandable from FIGS. 8 and 10.

While the child can move the upper casing unit 18 relatively slow, and still effect a propelling of the vehicle 12 from the launcher 10, it should be appreciated that the faster the upper casing unit 18 is moved relative to the lower casing unit 16, the more rapid is the advancement of the ram 60. The faster the ram 60 moves, the faster the vehicle 12 is ejected or launched.

It will be appreciated that the wheels 90, owing to their lateral spacing which is correlated with the lateral spacing of the ribs 27, effect a guiding of the toy vehicle 12 such that it will be launched in a straight path. Thus, the vehicle 12 does not get cocked or skewed as it leaves the launcher 10. However, lesser width cars and even objects that are not in vehicular form can be launched. For instance, a marble could be launched.

There are two ways in which the toy vehicle 12 can be placed within the launcher 10 in preparation for a launch. One way is to simply lift the launcher 10 from the playing surface 14. By inclining the launcher 10 so that the open ends 30, 44 of the casing units 16, 18 are raised, one can simply introduce the rear end of the vehicle 12 (or other object) into the launcher 10. By gravity, the vehicle 12 will roll downwardly until its bumper 88 engages the thrust panel 61 of the ram 60. The depression 92 helps to hold the vehicle 12 in place during this initial stage. When the lower casing unit 18 is placed on the playing surface 14, the launcher 10 is in readiness for a launching operation. All that need be done at this stage is to impart a movement of the upper casing unit 18 in the direction of the arrow 94 (FIG. 6) relative to the lower casing unit 16.

On the other hand, the launcher 10 can remain on the playing surface 14. In this situation, the upper casing unit 18 is retracted so as to move the ram 60 rearwardly. When this is done, the vehicle 12 (or other object) can simply be inserted through the open ends of the two casing units 16, 18. Here again the depression 92 assists in retaining the vehicle 12 in place, yet producing a neglible resistance when the launching takes place.

It should be mentioned that when the upper casing unit 18 is moved in the direction of the arrow 94, then its rear wall 46, which in FIG. 5 is against the rear wall 32 of the lower casing unit 16, moves forwardly so as to abut the upstanding stop 34. Comparison of FIG. 5 with FIG. 6 will show the limited or restricted amount of travel that can occur when the upper casing unit 18 is moved in the direction of the arrow 94, that is, from the rightmost position of FIG. 5 to the leftmost position of FIG. 6.

It will be understood that a certain amount of competition can be achieved with two similar launchers 10 and two similar toy vehicles 12. The harder and more rapid the upper casing unit 18 is moved relative to the lower casing unit 16 causes the toy vehicle 12 to be launched faster. The faster the toy vehicle 12 is launched, the greater the momentum it has; consequently, the toy vehicle that is launched faster, assuming that the vehicle 12 is identical or closely identical to the competitor's vehicle, will travel correspondingly farther. In this way, two or more participants can have races in which they compete with each other. Of course, the child can conduct successive races, so to speak, by himself comparing the distances traveled by the vehicle 12 after each launch. Thus, there is an element of challenge that is inherent with a launcher 10 constructed in accordance with the teachings of our invention.

We claim:

1. A manually actuated toy launcher comprising a first unit adapted to be placed in a stable position on a playing surface, a second unit, means on said units constraining the second unit to rectilinear movement between a retracted and an advanced position; relative to said first unit, a ram reciprocably disposed in said second unit for movement relative to both of said units and for engaging the toy that is to be launched, and means on said units for transmitting relative motion of said second with respect to said first unit from said second unit to said ram to cause said ram to push against said toy to launch said toy when said second unit is manually shifted from a retracted position to an advanced position relative to said first unit, said motion transmitting means including a motion multiplying mechanism so that said ram moves in the same direction as said second unit moves and at a more rapid rate relative to said second unit than said second unit moves relative to said first unit.

2. A launcher in accordance with claim 1 in combination with the toy that is to be launched, the toy constituting a vehicle and said ram engaging one end of the vehicle to launch said vehicle.

3. A manually actuated toy launcher comprising a first unit adapted to be placed in a stable position on a playing surface, means on said units for constraining said second unit to rectilinear movement between a retracted and an advanced position relative to said first unit, a ram reciprocably disposed in said second unit for engaging the toy that is to be launched, and means for transmitting motion from said second unit to said ram to cause said ram to push against said toy to launch said toy when said second unit is manually actuated from a retracted position to an advanced position relative to said first unit, said motion transmitting means including a shaft journally engaging said second unit and movable in unison therewith, a pair of circular members on said shaft having different diameters, the larger circular member being in engagement with said ram and the smaller circular member being in engagement with said first unit.

4. A launcher in accordance with claim 3 in which said motion transmitting means includes a first gear rack on said ram, a second gear rack on said first unit, said first and second circular members being a first circular gear engaged with said first rack and a second circular gear engaged with said second rack.

5. A launcher in accordance with claim 4 in which said first gear is larger than said second gear.

6. A launcher in accordance with claim 5, said first and second circular gears being mounted on said shaft for rotation therewith.

7. A launcher in accordance with claim 6 including a third gear rack on said first unit spaced laterally from said second rack, a third circular gear engaged with said third rack, said second and third circular gears flanking said first gear and said second and third racks being spaced laterally a distance at least equal to the width of said first gear so that the periphery of said first gear can rotate between said second and third racks.

8. A manually actuated toy vehicle launcher comprising a first casing unit adapted to be placed in a stable position on a playing surface, said first casing unit having a floor for supporting a toy vehicle that is to be launched, said first casing unit having grooves at each side thereof, a second casing unit having means slidably engaging in said grooves so as to constrain said second casing unit for rectilinear movement relative to said first casing unit, respective means on said casing units for restricting the amount of said rectilinear movement, a ram reciprocably disposed in said second casing unit for movement relative to both of said units and for engaging one end of said toy vehicle, and means on said units for transmitting motion from said second casing unit to said ram when said second casing unit is manually moved relative to said first casing unit to cause said ram to move relative to both of said units and to push against one end of said toy vehicle to launch said toy vehicle.

9. A launcher in accordance with claim 8 in which said transmitting means includes a pair of rotatable members having different diameters, the larger of said rotatable members engaging said ram and the smaller of said rotatable members engaging said first casing unit so that said ram moves in the same direction said second casing unit is manually moved and at a more rapid rate than said second casing is manually moved.

10. A launcher in accordance with claim 9 in which said rotatable members constitute circular gears.

11. A launcher in accordance with claim 8 in which said ram includes a rectangular thrust panel.

12. A launcher in accordance with claim 11 in which said thrust panel has a pair of laterally spaced notches in the upper edge thereof, and said second casing unit has a pair of downwardly depending ribs extending into said notches.

13. A launcher in accordance with claim 12 in which said first casing unit has a pair of upwardly directed ribs, the lower edge of said thrust panel riding along said upwardly directed ribs.

14. A launcher in accordance with claim 13 in which said upwardly directed ribs also function as guides for the toy vehicle to be launched.

15. A manually actuated toy vehicle launcher comprising a first casing unit adapted to be placed in a stable position on a playing surface, said first casing unit having a floor for supporting a toy vehicle that is to be launched, said first casing unit having grooves at each side thereof, a second casing unit having means slidably engaging in said grooves so as to constrain said second casing unit for rectilinear movement relative to said first casing unit, respective means on said casing units for restricting the amount of said rectilinear movement, a ram reciprocably disposed in said second casing unit for engaging one end of said toy vehicle, and means for transmitting motion from said second casing unit to said ram to cause said ram to push against one end of said toy vehicle to launch said toy vehicle, said transmitting means including a first gear rack integral with said ram and a second gear rack integral with said first casing unit, and a pair of circular gears having different diameters, the larger of said circular gears engaging said first gear rack and the smaller of said circular gears engaging said second rack.

16. A launcher in accordance with claim 15 in which said transmitting means includes a rotatable shaft having its ends journaled for rotation in said second casing unit, said first and second gears both being mounted on said shaft.

17. A launcher in accordance with claim 16 including a bearing plate at each side of said second casing unit, said bearing plates each having a notch and the ends of said shaft being journaled for rotation in said notches.

* * * * *